US006575601B1

(12) United States Patent
Sitzema, Jr. et al.

(10) Patent No.: US 6,575,601 B1
(45) Date of Patent: Jun. 10, 2003

(54) LIGHTING FIXTURE OPTICAL ASSEMBLY INCLUDING RELECTOR/REFRACTOR AND SHROUD

(75) Inventors: Ronald L. Sitzema, Jr., Ellsworth, MI (US); Paul D. Cardwell, East Jordan, MI (US)

(73) Assignee: Lexalite International Corporation, Charlevoix, MI (US)

( * ) Notice: Subject to any disclaimer, the term of this patent is extended or adjusted under 35 U.S.C. 154(b) by 0 days.

(21) Appl. No.: 10/099,114

(22) Filed: Mar. 15, 2002

(51) Int. Cl.[7] ..... F21V 3/02

(52) U.S. Cl. ..... 362/340; 362/329; 362/338; 362/350

(58) Field of Search ..... 362/309, 311, 362/329, 336, 338, 340, 308, 809, 363, 362, 361, 351, 350, 337

(56) References Cited

U.S. PATENT DOCUMENTS

| | | | | | |
|---|---|---|---|---|---|
| 38,668 | A | * | 5/1863 | Gibson | 362/350 |
| 1,259,493 | A | | 3/1918 | Dorey | |
| 1,371,761 | A | * | 3/1921 | Halvorson | 362/343 |
| 1,612,804 | A | | 1/1927 | Dorey | |
| 1,758,977 | A | | 5/1930 | Rolph | |
| 2,307,247 | A | * | 1/1943 | Tuck | 362/96 |
| 2,818,500 | A | | 12/1957 | Franck | |
| 3,170,635 | A | * | 2/1965 | Curtin | 362/306 |
| 3,609,348 | A | | 9/1971 | Marosco et al. | |
| 4,160,286 | A | | 7/1979 | Merritt | |
| 4,180,851 | A | | 12/1979 | Ericson, Jr. | |
| 4,439,816 | A | | 3/1984 | Litchfield | |
| 4,460,945 | A | | 7/1984 | Chan et al. | |
| 4,658,339 | A | | 4/1987 | Tammery et al. | |
| 4,808,471 | A | | 2/1989 | Grunzinger | |
| 4,839,781 | A | | 6/1989 | Barnes et al. | |
| 4,839,782 | A | * | 6/1989 | Sikora | 362/363 |
| 4,903,180 | A | | 2/1990 | Taylor et al. | |
| 4,904,525 | A | | 2/1990 | Taniguchi et al. | |
| 4,933,227 | A | | 6/1990 | Stewart | |
| 5,444,606 | A | | 8/1995 | Barnes et al. | |
| 5,481,445 | A | | 1/1996 | Sitzema et al. | |

* cited by examiner

*Primary Examiner*—Sandra O'Shea
*Assistant Examiner*—Hargobind S. Sawhney
(74) *Attorney, Agent, or Firm*—Joan Pennington

(57) ABSTRACT

An optical assembly enables improved optical control of an uplight illumination component and a downward illumination component. The optical assembly includes a reflector/refractor and a shroud carried by the reflector/refractor. The reflector/refractor has a predefined shape and has a plurality of reflector/refractor prisms on an exterior body surface for reflecting and refracting light. The shroud has a plurality of prisms disposed proximate to the reflector/refractor prisms for providing optical control of incident light from the reflector/refractor. The shroud is formed substantially corresponding to the predefined shape of the reflector/refractor, surrounding and spaced from the reflector/refractor exterior body surface. The shroud is formed, for example, by vacuum forming or by injection molding technique. The shroud provides optical control of incident light from the reflector/refractor, generally refracting incident light from the reflector/refractor. The shroud prisms are generally aligned with the reflector/refractor prisms. The reflector/refractor prisms and the shroud prisms are substantially vertical prisms. The shroud is formed of a light transmitting material, such as a transparent or translucent polymeric material. The shroud is formed, for example, by blending transparent materials having different refractive indices, or by adding a pigment to a transparent material. The shroud optionally includes pigmentation to provide a selected color for the optical assembly. The shroud can be metalized to block the uplight component or to provide a portion of the transmitted illumination to certain uplight areas, or reflect and block the illumination.

20 Claims, 7 Drawing Sheets

LIGHTING FIXTURE OPTICAL ASSEMBLY INCLUDING RELECTOR/REFRACTOR AND SHROUD

FIELD OF THE INVENTION

The present invention relates to lighting fixtures and luminaires, and more particularly to an improved optical assembly including a combination of a reflector/refractor device and an optical control overlay device called a shroud.

Description of the Related Art

Various arrangements are known for reflectors when used as lighting fixtures and luminaires. Some known reflectors are manufactured in metals such as aluminum and steel, or of a glass or plastic. These materials are then painted, plated, or chemically brightened to function as reflectors. Vacuum metallizing, vapor or chemical deposition can be used to place a thin metal layer onto the surface of the metal, plastic or glass to act as reflector. When a very thin transparent metal layer is vacuum metalized or vapor deposited on a transparent plastic or glass contour, the coverage is often random and may produce a non-uniform appearance which causes the performance to be unpredictable. There are also prismatic internal reflection glass and plastic reflectors which use the index of refraction to control the reflectance of light and redirect it into a distribution of light. Some glass reflectors are known to use a metal cover spun around the exterior to eliminate uplight, radiated by the large rounded portion of their prism peaks and roots, and the cover is used as a means of glare control and to maintain a clean exterior internal reflection surface. However, this creates a very dark reflector exterior and a very bright aperture brightness, and when installed in a room this reflector produces very reduced uplight with no means of adjusting the glass reflectors' reflected surface brightness to any other ambient lighting concerns or conditions.

Improvements over prior art arrangements have been provided by prismatic reflector/refractor, such as disclosed in the following United States patents.

U.S. Pat. No. 4,839,781 issued to Josh T. Barnes and Ronald J. Sitzema Jun. 13, 1989 and assigned to the present assignee, discloses a reflector/refractor device for use with a variety of lighting fixtures and light sources. The reflector/refractor device includes a body having a predetermined profile and defining a cavity with the body having an inside surface and an outside surface. An illuminating source for emitting light is disposed within the cavity substantially along a central vertical axis of the body. The body includes a series of sectional zones for reflecting and refracting light. The exterior surface of the device includes a plurality of substantially vertical prisms consisting of reflective elements, refractive elements and elements that may be either reflective or refractive depending on light center location. These reflective or refractive elements act in combination to selectively vary light distribution characteristics of vertical and lateral angles, and intensities, by vertical displacement of the illuminating lamp source.

U.S. Pat. No. 5,444,606 issued to Josh T. Barnes and Paul C. Belding Aug. 22, 1995 and assigned to the present assignee, discloses a combination of a prismatic reflector and a prismatic lens is provided for use with lighting fixtures. A reflector body has a substantially parabolic contour defining an interior cavity. The reflector body includes a plurality of prisms for receiving, transmitting and reflecting light. A lens body has a first mating surface engaging the reflector body, an opposed inverted conical surface, and a sloping sidewall extending between the mating surface and the opposed inverted conical surface. The mating surface of the lens body has a larger diameter than the opposed inverted conical surface. The opposed inverted conical surface includes a plurality of prisms for receiving and for redirecting light.

A need exists for an effective mechanism for controlling the uplight and surface luminance in the 60–90 degree glare zone, from prismatic reflectors. One known arrangement encloses the exterior of a prismatic glass reflector in aluminum as a means of controlling the uplight. This arrangement creates a dark black surface in the 60–90 degree glare zone in contrast to a bright opening at the bottom of the reflector. The use of paint on the exterior surface of prismatic reflectors causes the refraction index on the material to change by eliminating the air/plastic interface and this allows the paint to absorb a large portion of the illumination that strikes the painted surface resulting in a significant loss of efficiency of the optical assembly performance.

Another known arrangement simply encloses the reflector with a smooth, clear or white, cover. This arrangement protects the prism reflecting surfaces from deposits that could interfere with their total internal reflecting properties. A simple smooth cover may work as a dust cover; however, this arrangement fails to provide any improvement in the control or contrast of the uplight component or to the surface luminance in the 60–90 degree glare zone, down-light component of the prismatic reflector. Molding a prismatic glass or plastic reflector in a specific color causes large efficiency losses in the performance, as the molded in color will absorb all other colors and only reflect the color that the reflector is molded in. This essentially makes the reflector a monochromatic reflected light source while the lamp may produce white light.

It is desirable to provide an optical assembly enabling improved optical control of an uplight illumination component. It is desirable also to provide an optical assembly enabling improved optical control of a downward illumination component enabling the reduction of glare between the 60° and 90° vertical angles of viewing. It is desireable to selectively produce colored uplight from the optical assembly in certain lighting installations, without creating large losses in efficiency, or creating a monochromatic reflected light from the molded-in pigmented reflector prisms.

SUMMARY OF THE INVENTION

A principal object of the present invention is to provide an optical assembly enabling improved optical control of an uplight illumination component and a downward illumination component enabling the reduction of glare between the 60° and 90° vertical angles of viewing. Other important objects of the present invention are to provide such optical assembly substantially without negative effect and that overcome many of the disadvantages of prior art arrangements.

In brief, an optical assembly enables improved optical control of an uplight illumination component and a downward illumination component. The optical assembly includes a reflector/refractor device and a shroud carried by the reflector/refractor device. The reflector/refractor has a predefined shape and has a plurality of reflector/refractor prisms on an exterior body surface for reflecting and refracting light. The shroud has a plurality of prisms disposed proximate to the reflector/refractor prisms for providing optical control of incident light from the reflector/refractor body.

In accordance with features of the invention, the shroud is formed substantially corresponding to the predefined shape of the reflector/refractor, surrounding and spaced from the reflector/refractor exterior body surface. The shroud is formed, for example, by vacuum forming or by injection molding technique. The shroud provides optical control of incident light from the reflector/refractor body, generally refracting incident light from the reflector/refractor body. The shroud prisms are generally aligned with the reflector/refractor prisms. The reflector/refractor prisms and the shroud prisms are substantially vertical prisms. The shroud is formed of a light transmitting material, such as a transparent or translucent polymeric material. The shroud optionally is formed by blending transparent materials having different refractive indices, and optionally by adding a pigment to an otherwise transparent material. The shroud optionally includes such pigmentation to provide a selected color for the optical assembly. The shroud optionally is metalized or pigmented to block the uplight component or to provide a portion of the transmitted illumination to certain uplight areas, or reflect and block the illumination.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In accordance with the invention, an improved optical assembly is provided by a clear prismatic reflector/refractor having its exterior surface substantially covered with multiple internal reflecting prisms in combination with a shroud of the preferred embodiment that is arranged to provide additional optical control.

Figure 1A:
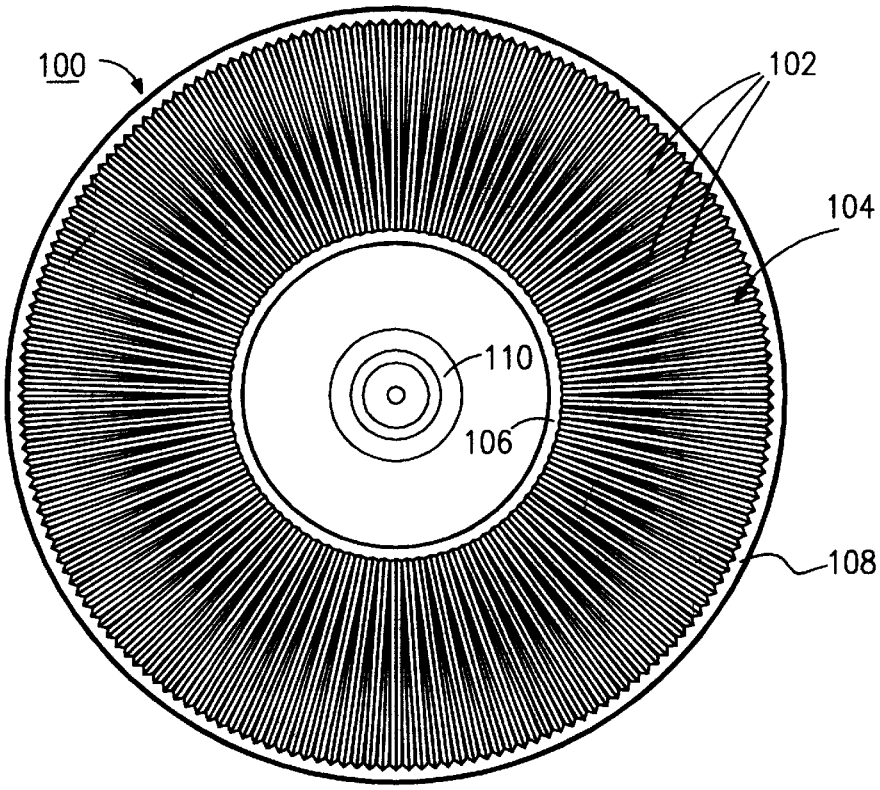
FIGS. 1A and 1B are top and side elevational views illustrating a prismatic reflector/refractor device in accordance with the preferred embodiment.
Figure 1B:
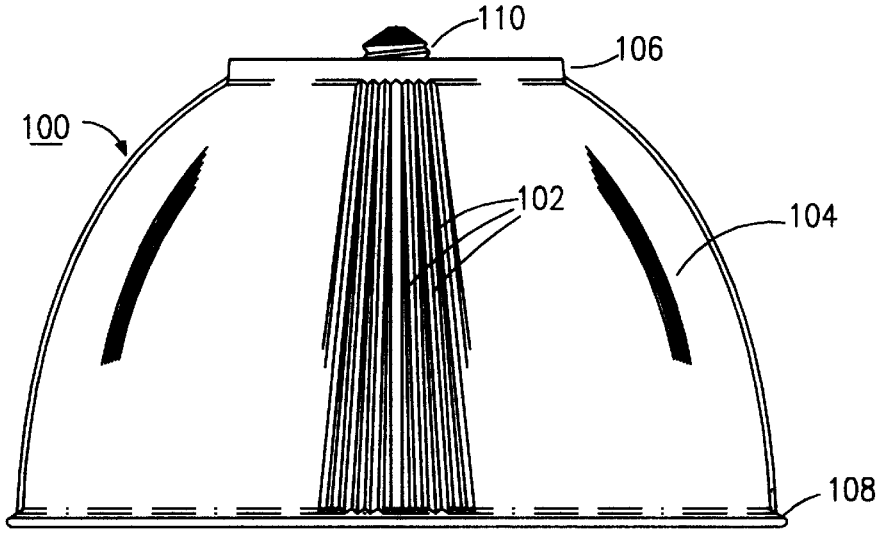
Figure 2:
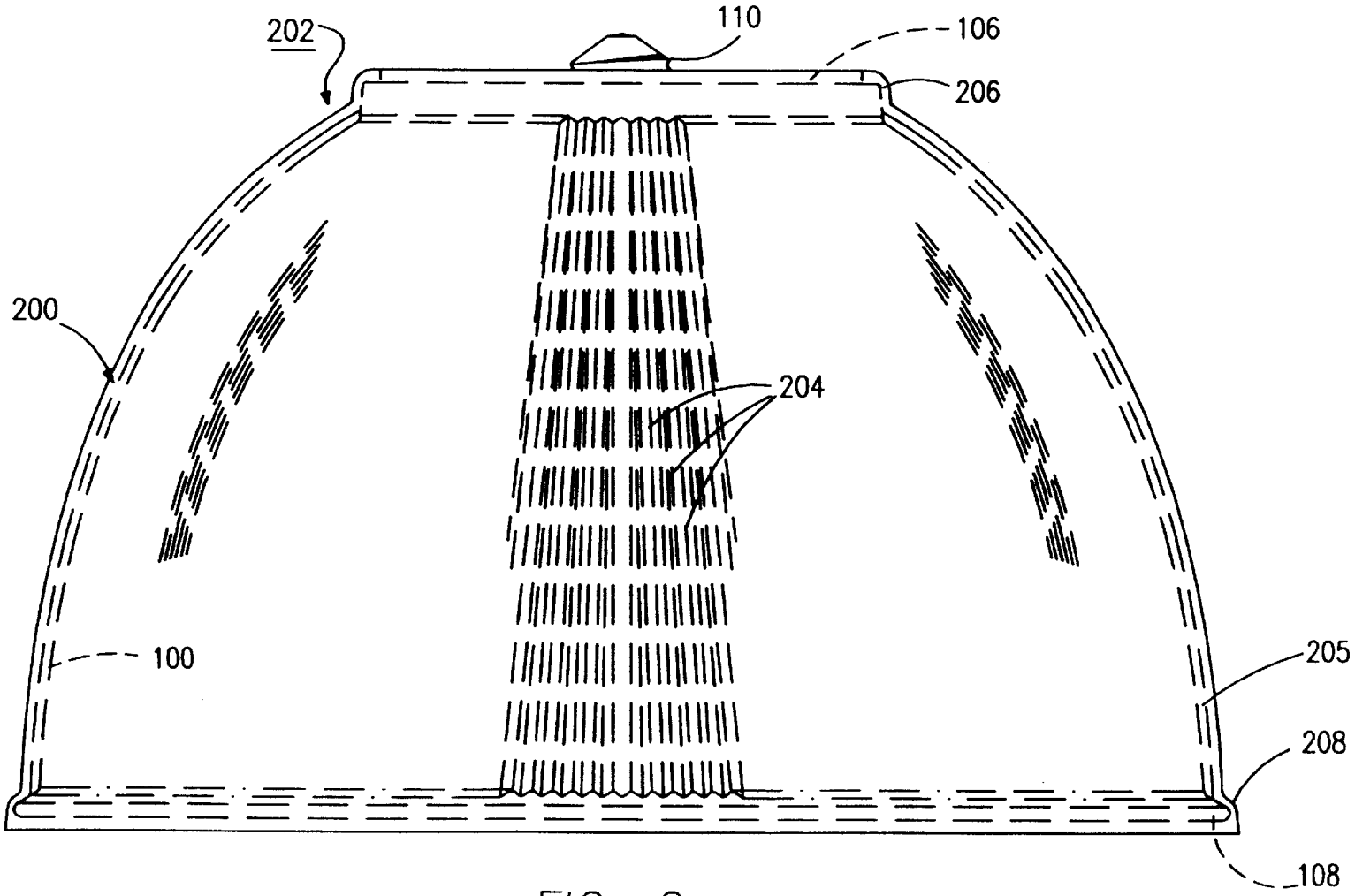
FIG. 2 is a side elevational view illustrating an optical assembly including a shroud in accordance with the preferred embodiment together with the prismatic reflector/refractor device of FIG. 1 shown in dotted line.
Figure 3:
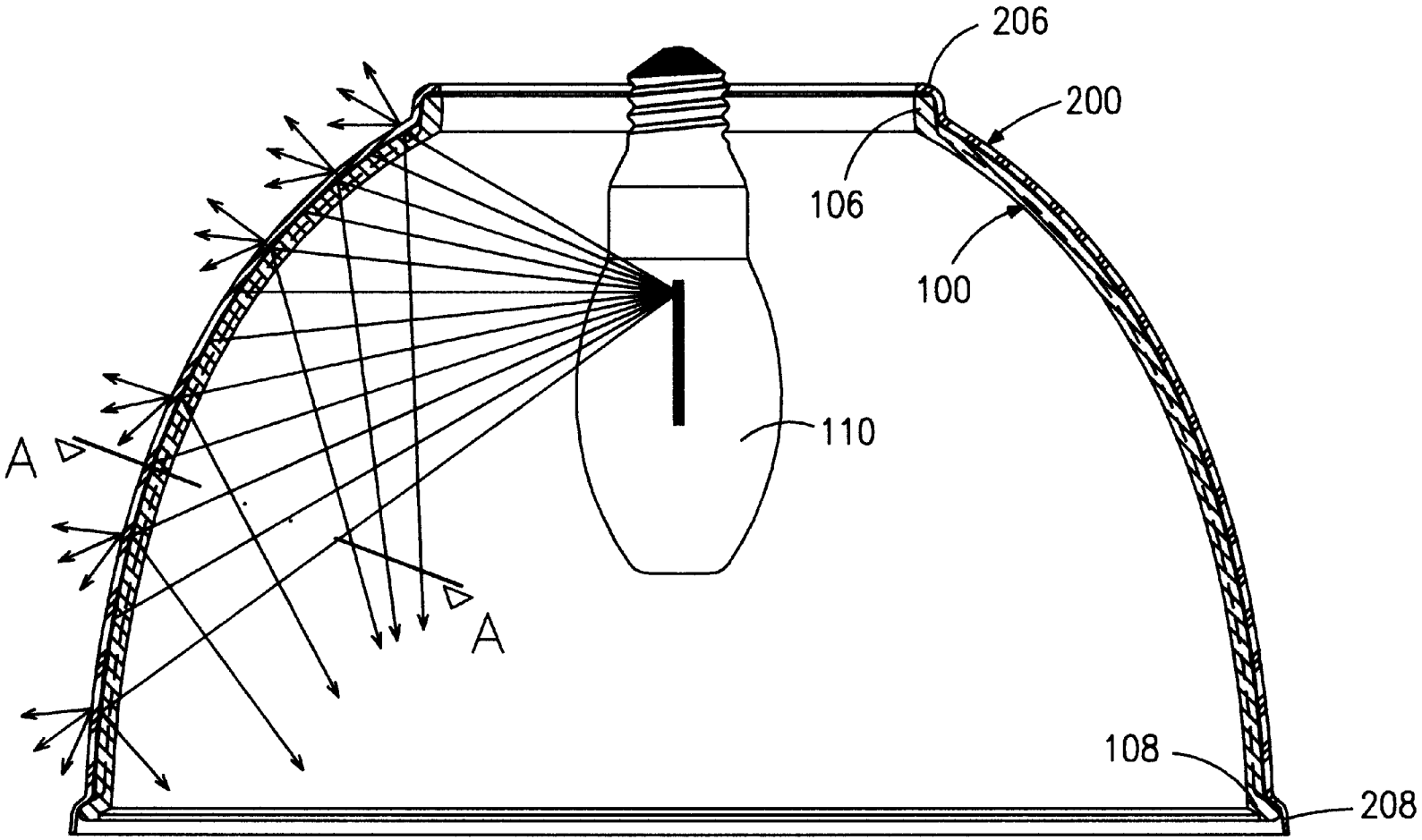
FIG. 3 is a cross-sectional view of the optical assembly of FIG. 2 illustrating improved function of the optical assembly including the shroud and prismatic reflector/refractor.

Having reference now to the drawings, in FIGS. 1A and 1B, there is shown a prismatic reflector/refractor device generally designated as 100 in accordance with the preferred embodiment. The prismatic reflector/refractor 100 is formed of a substantially transparent light transmitting material, such as an acrylic or similar material.

Prismatic reflector/refractor 100 is specifically designed to provide a certain amount of additional light through its sidewall for adding additional illumination to the surround, increasing the uniformity in the surround, and for spreading the lamp image over a larger area to reduce glare from a light source or lamp 110. Additionally certain pigments and diffusing agents can be added to the typically clear reflector/refractor 100 to increase diffusion and reduce glare; however, this typically results in a loss of efficiency of the entire optical assembly performance in both the uplight component and the down-light component.

The reflector/refractor 100 of the preferred embodiment has a plurality of vertical prisms 102 on an outside or exterior surface 104 extending between an upper flange 106 and a lower flange 108. The prismatic reflector/refractor. 100 advantageously is the type described in the above-identified U.S. Pat. Nos. 5,444,606 and 4,839,781. The subject matter of each of the above-identified U.S. Pat. Nos. 5,444,606 and 4,839,781 is incorporated herein by reference.

In accordance with features of the invention, a shroud 200 and reflector/refractor 100 are provided in combination to construct an optical assembly 202 of the preferred embodiment as illustrated in FIGS. 2, 3, 4A, 4B, 5, 6, 7A and 7B. Shroud 200 is an optical part that improves glare control through a combination of one or more features of diffusion, optical refraction and optionally pigmentation when color generation is required.

Optical assembly 202 including shroud 200 of the preferred embodiment minimally affects the down-light component from the reflector/refractor 100 and reduces the uplight efficiency without eliminating the uplight component. The reduction in uplight may be variable depending on the type of application required. The glare reduction can be increased in the uplight component without large efficiency losses to the down-light component. Another feature of shroud 200 is that a selected color optionally is provided in the uplight component, without the huge reduction in down-light efficiency caused by pigmentation of the reflector/refractor 100. Optical assembly 202 including the shroud 200 avoids such disadvantage of the conventional arrangement.

Optical assembly 202 and shroud 200 of the preferred embodiment allows the internal reflection prisms 102 to operate at optimal efficiency in the clear relatively colorless transparent material while shroud 200 selectively enables modifying portions of the illumination transmitted by the internal reflection prisms 102 in the 60–90 degree glare zone and the 90–180 degree illuminated uplight area substantially without affecting the nadir to 60 degree down light component.

The shroud 200 including the vertically oriented prisms 204 aligned with the exterior of the reflector/refractor prisms 102 is designed to increase the refraction and spread of the illuminance emitted from the reflector/refractor 100 for reducing the surface luminance from the reflector/refractor in the direction of the viewer, located in the 60–90 degree glare zone of the down-light component, through one or several combinations of diffusion, refraction, metalized reflection and pigmentation incorporated into the shroud.

Referring to FIGS. 2, 3, 4A and 4B, the shroud 200 is formed with substantially the corresponding predefined shape of the reflector/refractor 100, surrounding the reflector/refractor exterior body surface. The shroud includes a plurality of prisms 204 generally aligned with prisms 104 with the reflector/refractor 100 when assembled in optical assembly 202. The reflector/refractor prisms 102 and the shroud prisms 204 are substantially vertical prisms. The escaping light rays or incident light from the reflector/refractor internal reflection prisms 102 illuminates the shroud 200.

The shroud 200 is designed to the fit over the exterior surface 104 of the reflector/refractor 100. A small air gap or cavity 205 is located between the internal reflection prisms 102 of the reflector/refractor 100 and the vertically oriented prisms 204 of the shroud 200. The shroud 200 includes an upper flange 206 carried by flange 106 of the reflector/refractor 100 and a lower flange 208 resting on the lower flange 108 of the reflector/refractor 100. The shroud 200 aligns its prisms 204 with the prisms 102 of the reflector/refractor 100 and effectively increases the surface area of the reflector/refractor. This increased surface area combined with either diffusion provided by the shroud 200, and the prismatic refraction of the shroud prisms 204 further reduces the apparent brightness of the reflector/refractor surface, which in turn reduces glare. Each shroud prism 204 aligned with the internal reflection prism 102 on the exterior surface 104 of the reflector/refractor 100, provides additional refraction to reduce the surface luminance of the reflector/refractor 100 when the viewer is located in the 60–90 degree glare zone of the down-light component.

The shroud 200 is formed of a light transmitting material, such as, a polymeric material and preferably is made from an acrylic material. However, it should be understood that various other materials could provide suitable alternatives for forming shroud 200. The shroud 200 can be formed of a transparent or translucent light transmitting material. The shroud 200 is formed, for example, by vacuum forming or by injection molding technique.

In the optical assembly 202, the shroud is carried by the reflector/refractor 100 with the shroud vertical prisms 204 generally aligned with the prisms 102 of the reflector/refractor device 100. The prismatic shroud 200 with the multitude of vertically oriented prisms 204 aligned with the reflector/refractor provides additional optical control of some or all of the uplight illumination, and the reduction of surface luminance toward the viewer located in the 60–90 degree glare zone of the down-light component, through one or more combinations of diffusion, refraction, metalized reflection and pigmentation incorporated into the shroud.

The shroud 200 is made from the colorless light diffusing material to provide only the minimal efficiency change while substantially changing the appearance and performance of the uplight component. A colorless light diffusing material advantageously is used in an application where only a reduction in apparent brightness of the lamp image is further diffused across a larger surface of the shroud 200.

The shroud 200 optionally is formed by blending transparent materials having different refractive indices, and optionally by adding a pigment to an otherwise transparent material. The polymeric shroud 200 is formed, for example, of a clear transparent acrylic having two different refraction indices to create a diffuse but high transmission material to further reduce surface luminance of the reflector/refractor, while transmitting the majority of the illumination from the reflector/refractor into the uplight component. For example, shroud 200 optionally is formed by two different types of clear acrylic material with slightly different refractive indices, and when combined in a sheet extrusion, creates a highly diffuse and highly light transmission material, for example, with roughly the same light transmission properties as a clear transparent acrylic resin. This material is then vacuum formed into shroud 200 generally conforming to the size and shape of the exterior surface 104 of the reflector/refractor 100 with the prisms 102 on the exterior of the reflector/refractor aligning with the prisms 204 formed into the shroud 200.

Another version of shroud 200 utilizes a similar concept using the injection molding of the two acrylic resins combined into molding pellets, each pellet having a mixed ratio of the two acrylics each acrylic having different refraction indices to create a desired diffusion and highly light transmissive material.

The shroud 200 optionally includes pigmentation to provide a selected color for the optical assembly. The shroud 200 can be formed of a pigmented light diffusing material to change the color of the uplight to create special color effects while the down-light component is left substantially unaffected to provide the required lighting levels for a particular installation. For example, the shroud 200 can be made from a white pigmented material, such as acrylic, for certain applications that simply want a reduced apparent lamp image from the exterior of the reflector/refractor 100 and coupled with the spreading prisms formed into the shroud create a uniform soft glowing exterior with greatly reduced surface luminance.

The shroud 200 functions as an additional optical control device for selectively modifying the surround. The reduction in glare or the introduction of additional color can be introduced into the illuminated environment either to improve the visual performance of individuals in an application, or create an illusion of a winter sky by using a blue shroud 200 on the exterior of a prismatic reflector/refractor 100. The ceilings would be illuminated in a soft blue/white illumination from a metal halide lamp while the floors would have the appearance of normal white light illumination from the same metal halide lamp. A black pigmented shroud 200 could be used where no uplight or down-light additions in illumination would be needed or to blend silhouette of the luminaire into a blacked ceiling and where the uplight might expose the ductwork or other unsightly building components. The shroud 200 can be selectively pigmented in black portions, for example, to absorb all illuminance in the uplight component and absorb any illuminance from the exterior of the reflector/refractor for a viewer located in the 60–90 degree glare zone and completely reducing the surface luminance of the reflector/refractor 100 without disturbing the internally reflected illumination controlled by the exterior prisms 102 of the reflector/refractor 100 that are directed through the bottom opening of the reflector/refractor.

Figure 5:
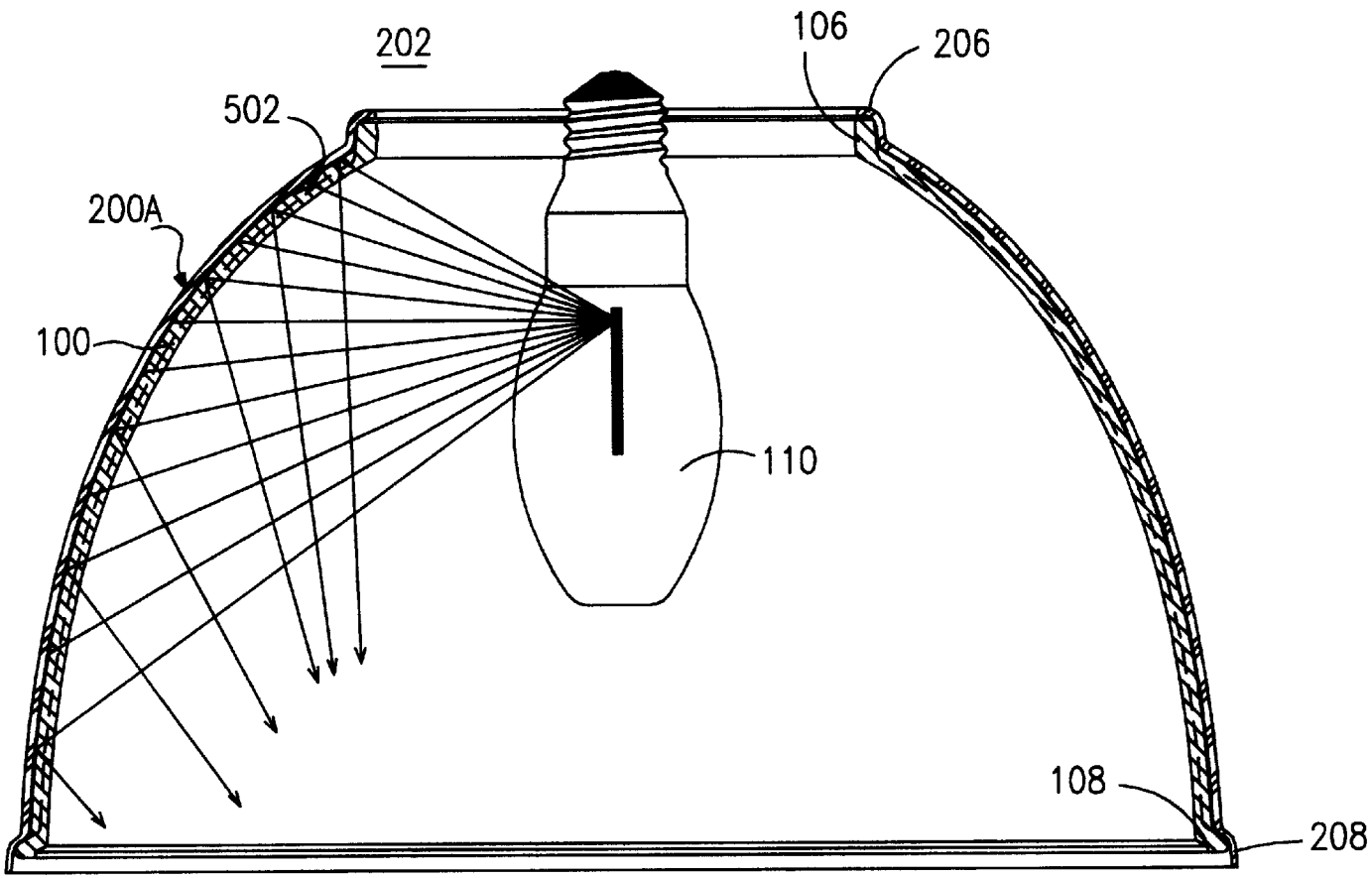
FIG. 5 is a cross-sectional view of the optical assembly of FIG. 2 in accordance with the preferred embodiment illustrating an alternative function of the optical assembly including a first metalized shroud in accordance with the preferred embodiment.
Figure 6:
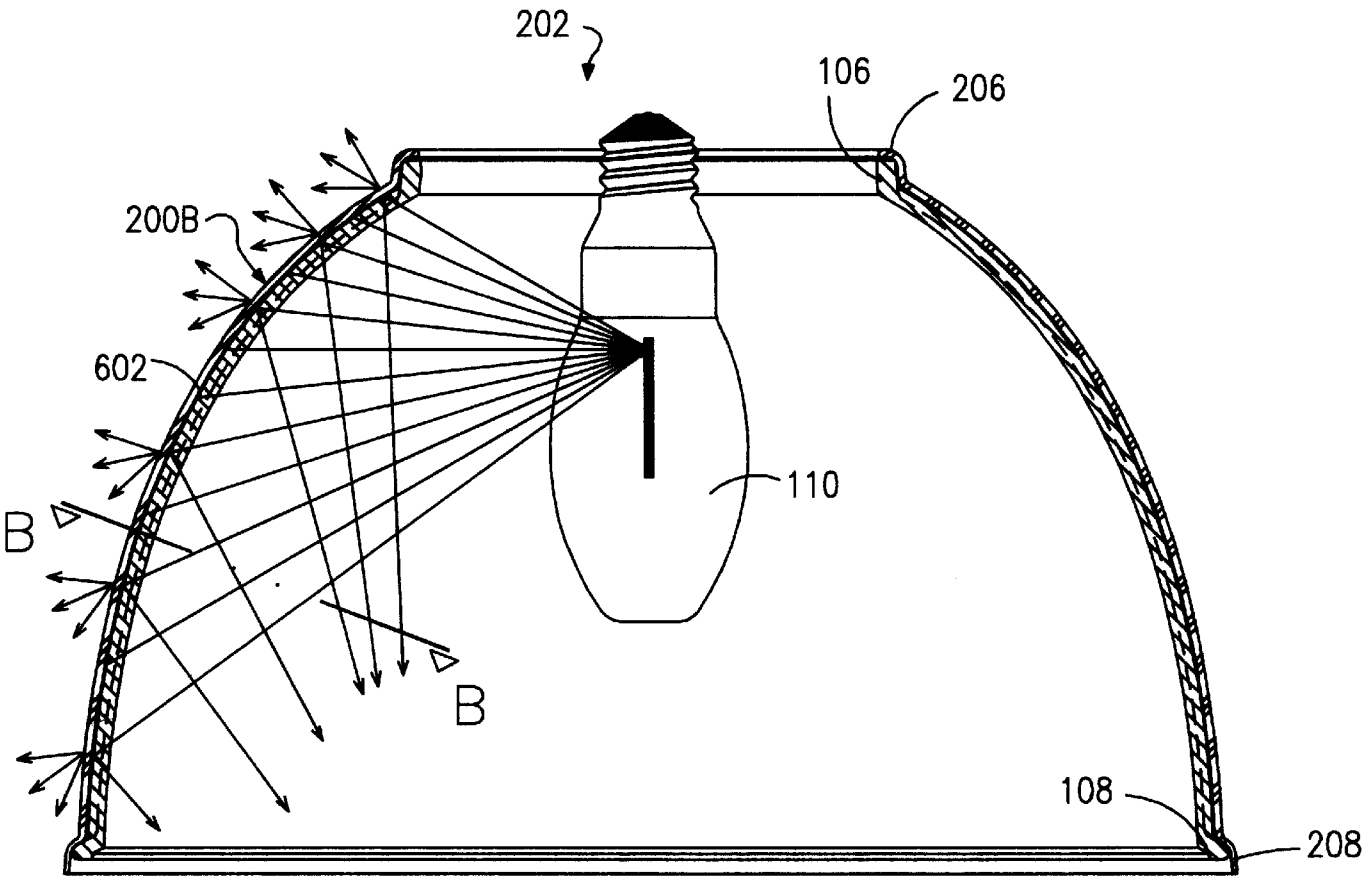
FIG. 6 is a cross-sectional view of the optical assembly of FIG. 2 in accordance with the preferred embodiment illustrating another alternative function of the optical assembly including a second metalized shroud in accordance with the preferred embodiment.
Figure 7B:
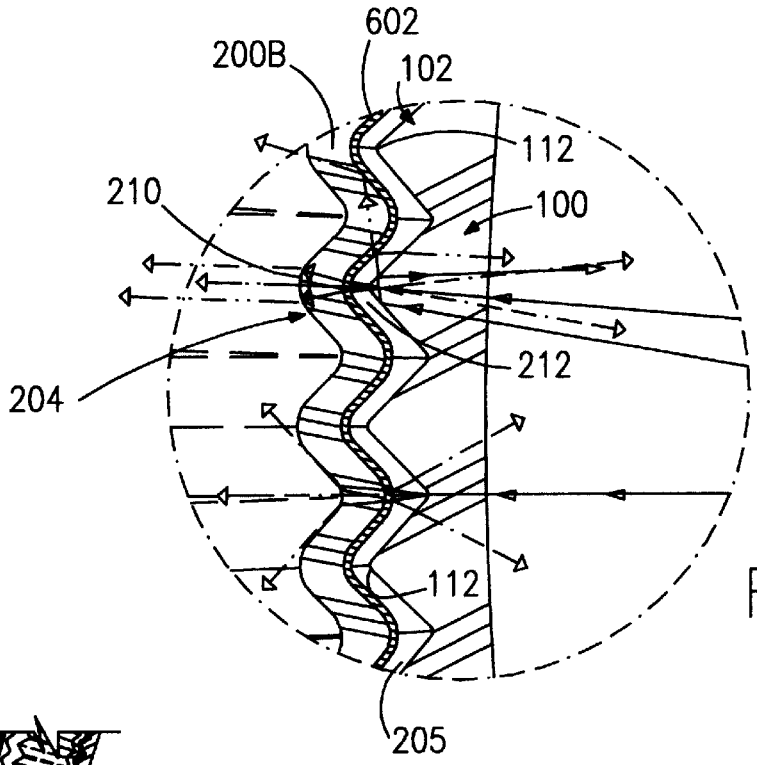
FIG. 7B is an enlarged fragmentary detailed view of the cross-sectional view of FIG. 7A
Figure 7A:
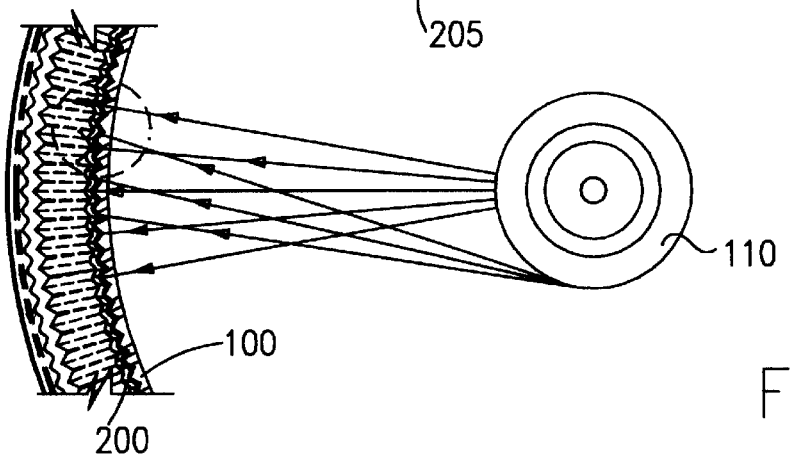
FIG. 7A is a cross-sectional view taken along the line B—B of FIG. 6.

The shroud 200 optionally is metalized to block the uplight component as illustrated in FIG. 5; or to provide a portion of the transmitted illumination to certain uplight areas and to block portions of the illumination as illustrated in FIGS. 6, 7A and 7B.

Figure 4B:
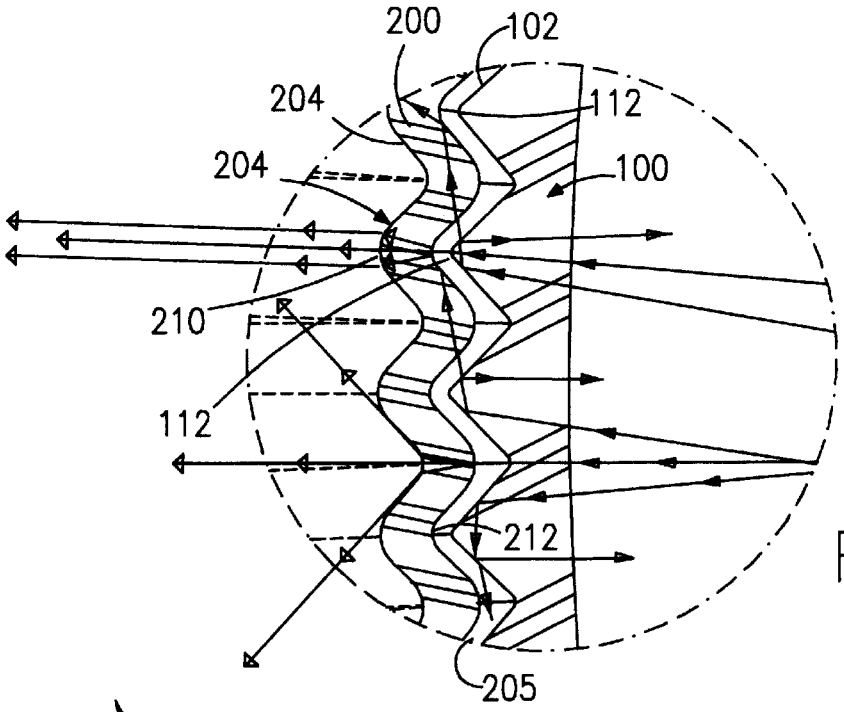
FIG. 4B is an enlarged fragmentary detailed view of the cross-sectional view of FIG. 4A.
Figure 4A:
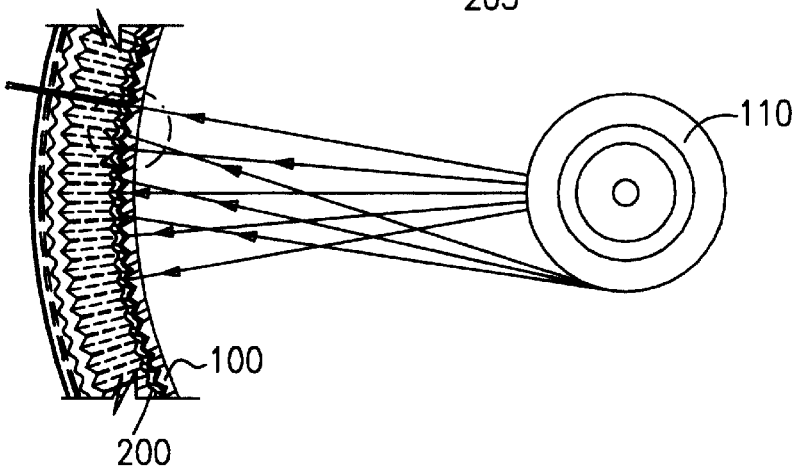
FIG. 4A is a cross-sectional view taken along the line A—A of FIG. 3.

As best seen in FIG. 4B, the shroud 200 carried over the internal reflection prisms 102 on the exterior surface 104 of the reflector/refractor 100 provides optical control of incident light from the reflector/refractor 100, generally refracting incident light from the reflector/refractor. Each of the vertically oriented prisms 204 has a prism shape best described as a meniscus prism. Meniscus prisms 204 has an exterior convex prism surface 210 and an interior concave surface 212 aligned facing a peak 112 of the internal reflection prism 102 of the reflector/refractor 100, for the purposes of creating additional surface refraction for the reduction of surface luminance from said reflector/refractor in the direction of a viewer located in 60–90 degree glare zone of the down-light component. The small air gap 205 extends between the internal reflection prisms 102 and the vertically oriented shroud prisms 204.

FIG. 5 illustrates an alternative function of the optical assembly 202 in accordance with the preferred embodiment including shroud 200A in accordance with the preferred embodiment having an additional inside surface layer of metal 502. Metal layer 502 of shroud 200A blocks or eliminates the uplight component and reflects the incident light from the reflector/refractor 100 as shown in FIG. 5. A vacuum metallization process, for example, forms metal layer 502 of shroud 200A. The shroud 200A is formed of light transmitting transparent material as shroud 200 and then vacuum metalized to deposit the uniform metal layer 502 on the interior surface. The shroud 200A is metalized to block the uplight component and when placed over the reflector/refractor 100, eliminates the lamp image in a building having a black ceiling and to reflect all of the illumination back into the reflector/refractor 100 to redistribute the reflected illumination into the down-light component As shown in FIG. 5, the metalized shroud 200A reflects a certain portion of the escaping light rays back into the reflector/refractor 100 where it is reflected in the down-light component.

Referring to FIGS. 6, 7A, and 7B, a further alternative function of the optical assembly 202 including a second metalized shroud 200B in accordance with the preferred embodiment. As shown, the second metalized shroud 200B also includes an additional inside surface layer of metal 602. The metalized shroud 200B can be selectively metalized to provide a portion of the transmitted illumination to certain uplight areas, or reflect and block the illumination where the amount of illumination is already adequate. The interior surface of the metalized shroud 200B is formed by a vacuum metallization process to range from transparent to opaque based on the length of deposition of the metallization process and the thickness of the metal that is applied. The non-uniform metal layer 602 is arranged to transmit a portion of the illumination in the uplight component, and reflect a portion of the illumination in the uplight and downward components. The shroud 200B is formed of light transmitting transparent material as shroud 200 and then vacuum metalized to deposit the non-uniform metal layer 602 on the interior surface to range from transparent to opaque.

The shroud 200B is metalized with aluminum or other suitable metals, deposited onto the interior concave prism surface of the shroud. The non-uniform metal of the non-uniform metal layer 602 can range from 45% transmission with 45% reflection of the rays escaping the internal reflection prismatic surface of the reflector/refractor, to less than 3% transmission with 84% reflection of the rays escaping the prismatic surface of the reflector/refractor. The non-uniform metal of the non-uniform metal layer 602 reflects a portion back into the prisms 102 for directing the rays back into and through the bottom opening of the reflector/refractor 100 and into the down-light component below the 60–90 degree glare zone.

The following Table 1 provides test report data measuring the Candela/Sq.M for a typical reflector/refractor 100 without a shroud having a surface luminance as follows.

TABLE 1

| Angle/degrees vertical | Average Luminance |
|---|---|
| 45 | 38292 |
| 55 | 14523 |
| 65 | 5831 |
| 75 | 6845 |
| 76 | 8914 |

The following Table 2 provides test report data measuring the Candela/Sq.M for an optical assembly 202 having a typical reflector/refractor 100 with a shroud 200 formed of an acrylic, pigmented white material manufactured by PSI of Olive Branch, Mississippi, having a surface luminance as follows.

TABLE 2

| Angle/degrees vertical | Average Luminance |
|---|---|
| 45 | 31644 |
| 55 | 11046 |
| 65 | 3174 |
| 75 | 3367 |
| 85 | 4130 |

The following Table 3 provides test report data measuring the Candela/Sq.M for an optical assembly 202 having a typical reflector/refractor 100 with a shroud 200 formed of an acrylic, pigmented white material by another manufacturer having a surface luminance as follows.

TABLE 3

| Angle/degrees vertical | Average Luminance |
|---|---|
| 45 | 33368 |
| 55 | 12006 |
| 65 | 3217 |
| 75 | 2625 |
| 85 | 2761 |

The following Table 4 provides test report data measuring the Candela/Sq.M for a typical reflector/refractor 100 with a shroud 200 formed of an acrylic material with two different clear polymethyl methacrylates (PMMAs), each having different refractive indices of clear acrylic material that when molded create a pigmented white diffusion material surface without the losses normally associated with pigmentation. The following Table 4 surface luminance was measured.

TABLE 4

| Angle/degrees vertical | Average Luminance |
|---|---|
| 45 | 34956 |
| 55 | 12466 |
| 65 | 4455 |
| 75 | 5513 |
| 85 | 7275 |

While the present invention has been described with reference to the details of the embodiments of the invention shown in the drawing, these details are not intended to limit the scope of the invention as claimed in the appended claims.

What is claimed is:

1. An optical assembly enabling optical control of an uplight illumination component and a downward illumination component; said optical assembly comprising:

a reflector/refractor; said reflector/refractor having a predefined shape and having a plurality of reflector/refractor prisms on an exterior body surface for reflecting and refracting light; and a shroud carried by said reflector/refractor device; said shroud having a plurality of prisms disposed proximate to said reflector/refractor prisms for providing optical control of incident light from said reflector/refractor.

2. An optical assembly enabling optical control of an uplight illumination component and a downward illumination component as recited in claim 1 wherein said shroud is formed of a light transmitting, transparent or a translucent material.

3. An optical assembly enabling optical control of an uplight illumination component and a downward illumination component as recited in claim 1 wherein said shroud is formed of a light transmitting polymeric material.

4. An optical assembly enabling optical control of an uplight illumination component and a downward illumination component as recited in claim 1 wherein said shroud is formed of a light transmitting acrylic material.

5. An optical assembly enabling optical control of an uplight illumination component and a downward illumination component as recited in claim 1 wherein said shroud is formed of substantially said predefined shape of said reflector/refractor and surrounding and spaced from said reflector/refractor exterior body surface.

6. An optical assembly enabling optical control of an uplight illumination component and a downward illumination component as recited in claim 1 wherein said shroud is formed by vacuum forming or by injection molding.

7. An optical assembly enabling optical control of an uplight illumination component and a downward illumination component as recited in claim 1 wherein said shroud provides optical control of incident light from the reflector/refractor by substantially refracting incident light from said reflector/refractor.

8. An optical assembly enabling optical control of an uplight illumination component and a downward illumination component as recited in claim 1 wherein said shroud prisms are vertical prisms generally aligned with sad reflector/refractor prisms.

9. An optical assembly enabling optical control of an uplight illumination component and a downward illumination component as recited in claim 1 wherein said shroud is formed from two transparent materials having different refractive indices.

10. An optical assembly enabling optical control of an uplight illumination component and a downward illumination component as recited in claim 1 wherein said shroud is formed from a pigmented material.

11. An optical assembly enabling optical control of an uplight illumination component and a downward illumination component as recited in claim 1 wherein said shroud is formed from a material including a pigmentation to provide a selected color for the optical assembly.

12. An optical assembly enabling optical control of an uplight illumination component and a downward illumination component as recited in claim 1 wherein said shroud includes an interior metal layer to block the upright illumination component.

13. An optical assembly enabling optical control of an uplight illumination component and a downward illumination component as recited in claim 1 wherein said shroud includes an interior metal layer to provide a set portion of the uplight illumination component to certain uplight areas.

14. An optical assembly enabling optical control of an uplight illumination component and a downward illumination component as recited in claim 13 wherein said shroud includes said interior metal layer to control surface luminance from the reflector/refractor in the direction of a viewer located in the 60–90 degree glare zone of the downward illumination component.

15. An optical assembly enabling optical control of an upright illumination component and a downward illumination component as recited in claim 1 wherein said shroud provides optical control of incident light from the reflector/refractor by a combination of one or more of refracting incident light from said reflector/refractor; diffusing incident light from said reflector/refractor, and reflecting incident light from said reflector/refractor.

16. An optical assembly enabling optical control of an uplight illumination component and a downward illumination component as recited in claim 1 wherein each said shroud prism has a meniscus lens shape with an exterior prism surface being convex and an interior surface being concave and aligned with a peak of said reflector/refractor prism.

17. A shroud for optical control used in combination with a reflector/refractor; said reflector/refractor having a predefined shape and having a plurality of reflector/refractor prisms on an exterior body surface for reflecting and refracting light; said shroud comprising:

a light transmitting shroud member having substantially said predefined shape of said reflector/refractor and surrounding said reflector/refractor exterior body surface; and said light transmitting shroud member forming a plurality of prisms disposed proximate to said reflector/refractor prisms for providing optical control of incident light from said reflector/refractor.

18. A shroud for optical control used in combination with a reflector/refractor as recited in claim 17 wherein said light transmitting shroud member prisms disposed proximate to said reflector/refractor prisms for providing optical control of incident light from said reflector/refractor increase refraction and spread of incident light from said reflector/refractor.

19. A shroud for optical control used in combination with a reflector/refractor as recited in claim 17 wherein said light transmitting shroud member prisms disposed proximate to said reflector/refractor prisms for providing optical control of incident light from said reflector/refractor by a combination of one or more of material characteristics forming said light transmitting shroud member including diffusion, refraction, and pigmentation.

20. A shroud for optical control used in combination with a reflector/refractor as recited in claim 17 wherein said light transmitting shroud member further includes an interior metal layer proximate to said reflector/refractor; said metal layer formed by a vacuum metallization process for providing selected optical control of incident light from said reflector/refractor.

* * * * *